US006320361B2

(12) United States Patent
Dima et al.

(10) Patent No.: US 6,320,361 B2
(45) Date of Patent: Nov. 20, 2001

(54) BUFFER DEVICE WITH DUAL SUPPLY VOLTAGE FOR LOW SUPPLY VOLTAGE APPLICATIONS

(75) Inventors: Vincenzo Dima, Monza; Lorenzo Bedarida, Vimercate; Antonino Geraci, Lercara Friddi; Simone Bartoli, Cambiago, all of (IT)

(73) Assignee: STMicroelectronics S.R.L, Agrate Brianza (IT)

( * ) Notice: Subject to any disclaimer, the term of this patent is extended or adjusted under 35 U.S.C. 154(b) by 0 days.

(21) Appl. No.: 09/736,984

(22) Filed: Dec. 13, 2000

(30) Foreign Application Priority Data

Dec. 13, 1999 (IT) ..... MI99A2576

(51) Int. Cl.[7] ..... G05F 1/40

(52) U.S. Cl. ..... 323/284; 323/311; 326/81; 327/543

(58) Field of Search ..... 323/282, 284, 323/311, 312; 326/17, 21, 31, 33, 34, 80, 81, 83, 86, 98, 119; 327/108, 112, 530, 543

(56) References Cited

U.S. PATENT DOCUMENTS 5,105,104 * 4/1992 Eisele et al. ..... 307/448
5,903,500 * 5/1999 Tsang et al. ..... 365/189.05
6,060,910 * 5/2000 Inui ..... 326/98
6,069,496 * 5/2000 Perez ..... 326/98
6,078,195 * 6/2000 Chen ..... 326/121

* cited by examiner

*Primary Examiner*—Peter S. Wong
*Assistant Examiner*—Gary L. Laxton
(74) *Attorney, Agent, or Firm*—Robert Iannucci; Seed Law Group, PLLC

(57) ABSTRACT

An output buffer device having first and second supply voltage references, the first voltage reference being lower in value than the second voltage reference. The output buffer device includes first and second complementary MOS transistors, which transistors are connected in series together between one of the supply voltage references and a further voltage reference, have gate terminals connected together and to an input terminal of this buffer device, and have drain terminals connected together and to an output terminal of the buffer device. Advantageously, the first transistor is connected to the first supply voltage reference. Furthermore, the output buffer device comprises at least one additional drive MOS transistor of the same type as the first MOS transistor and placed between the second supply voltage reference and the output terminal of the buffer device.

15 Claims, 1 Drawing Sheet

BUFFER DEVICE WITH DUAL SUPPLY VOLTAGE FOR LOW SUPPLY VOLTAGE APPLICATIONS

TECHNICAL FIELD

This invention relates to a buffer device with dual supply voltage for low supply voltage applications.

Specifically, the invention relates to an output buffer device having first and second supply voltage references, said first voltage reference being lower in value than said second voltage reference, of the type which comprises at least first and second complementary MOS transistors, which transistors are connected in series together between one of said supply voltage references and a further voltage reference, have gate terminals connected together and to an input terminal of said buffer device, and have drain terminals connected together and to an output terminal of the buffer device.

The invention relates, particularly but not exclusively, to an output buffer device with dual supply voltage, and this description will cover that field of application for convenience of illustration only.

BACKGROUND OF THE INVENTION

As is well known, an abiding demand exists from the trade for semiconductor devices that can be operated at increasingly low supply voltages and large bandwidths.

The output buffers are a major design constraint in such devices. The desire is that such buffers output data at a very high rate despite being supplied a reduced voltage.

The problems encountered in the design of output buffer devices are intensified particular with devices that have a low internal supply voltage, while the supply voltage to the output buffers is still lower.

Shown schematically in FIG. 1 is a typical structure of an output buffer device 1. In particular, the output buffer device 1 comprises a complementary pair of CMOS transistors M1, M2 which are connected in series together between a supply voltage reference Vcc and a second voltage reference, specifically a ground reference GND, and have control terminals connected together and to an input terminal IN of the output buffer device 1, the latter being a voltage input signal Vin.

The passage from a logic low to a logic high, referred to as a low/high transition, of an output voltage signal Vpad at an output terminal PAD is effected in two steps, as specified herein below. 1. When Vpad<|Vtp|, the PMOS transistor M1 is in a saturated condition, and the charge current Ic which raises the value of the voltage Vpad at the output terminal PAD is constant and given approximately as:

$$Ic = \frac{Kp(Vcc + Vtp)^2}{2Zp} \tag{1}$$

where:

Kp=$\mu$·Cox,

1/Zp=W/L (geometric parameters of PMOS transistor M1),

Vtp is the threshold voltage of PMOS transistor M1, $\mu$ is the electron mobility, and Cox is the capacitance of the silicon layer of the transistors.

2. When Vpad>|Vtp|, the PMOS transistor M1 is in the triode range, and the charge current Ic is dependent on the voltage Vpad presented at the output terminal PAD, it being given as:

$$Ic = \frac{Kp(Vcc/2 + Vtp + Vpad/2)(Vcc - Vpad)}{Zp} \tag{2}$$

It appears from formulae (1) and (2) above that the charge current Ic is "quadratically" proportional to the supply voltage Vcc. With low supply voltages, large geometries (small values of Zp) must be used to provide the required fast transfer of the output data.

A state-of-art buffer device is disclosed for a supply voltage of 1.5V in U.S. Pat. No. 5,903,500 to Tsang et al. This document is related in particular to flash memories, and describes a high-speed output buffer device, which comprises a high-transconductance NMOS transistor suitably doped to have a lower threshold voltage than the threshold voltage of standard NMOS transistors.

The underlying technical problem of this invention is to provide an output buffer device for low supply voltage devices, which has such structural and functional features that it can overcome the constraints of comparable prior devices.

SUMMARY OF THE INVENTION

One embodiment of this invention uses an internal supply voltage reference of the buffer device to provide an optional path toward the output terminal, which would be selected by a control signal being issued from sensing circuitry.

The sensing circuitry monitors the input and output terminals of the buffer. When the input terminal begins a transition from one logic state to another, the sensing circuitry opens a current path from the internal supply voltage reference to the output terminal, providing additional current to the output terminal, reducing the charge time of the buffer circuit.

The features and advantages of a buffer device according to the invention will become apparent from the following description of an embodiment thereof, given by way of example and not of limitation with reference to the accompanying drawings.

DETAILED DESCRIPTION OF THE INVENTION

Figure 1:
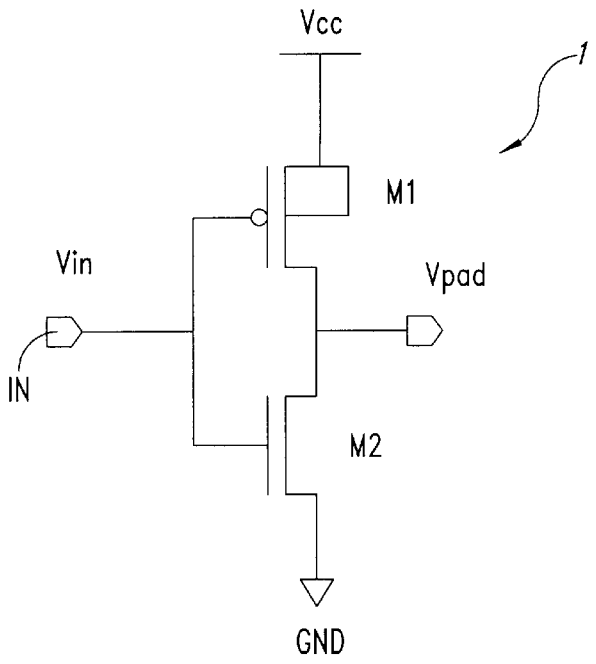
Fig. 1 (Prior Art)
FIG. 1 shows schematically the basic structure of an output buffer device according to the prior art.
Figure 2:
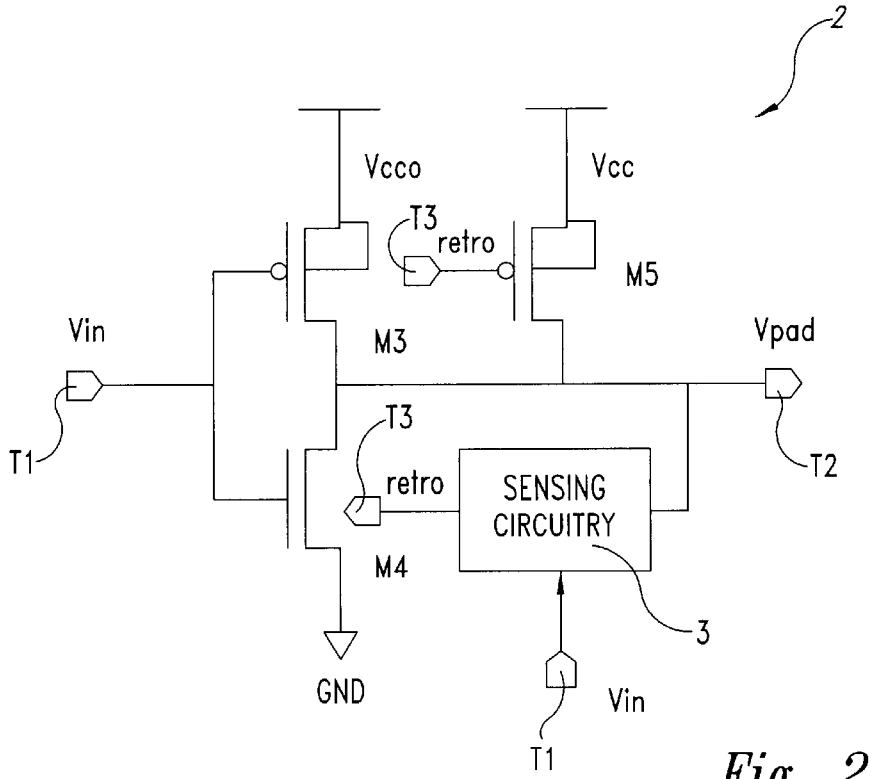
FIG. 2 shows schematically an output buffer device embodying this invention.

Referring in particular to FIG. 2, an output buffer device according to this invention is shown generally at 2.

The output buffer device 2 comprises a pair of CMOS transistors, M and M4, having gate terminals connected together and to an input terminal T1 of the output buffer device 2. These transistors M3 and M4 have drain terminals connected together and to an output terminal or pad T2 of the output buffer device 2.

Advantageously, the transistors M3 and M4 are placed between a supply voltage reference Vcco for the output buffers and a second voltage reference, specifically a ground reference GND.

In fact, many devices are provided an internal supply voltage Vcc as well as a supply voltage Vcco for the output buffers which is lower than the internal supply voltage Vcc.

In particular, with the supply voltage reference Vcco for the output buffers being normally quite low, very large (small 1/Zp) buffer devices are used which can meet the speed specifications of high-performance devices.

The output buffer device 2 further comprises a drive PMOS transistor M5 which is connected between the internal supply voltage reference Vcc and the output terminal T2 and has a gate terminal connected to a control terminal T3, the latter being to receive control signal RETRO generated by appropriate sensing circuitry 3.

In particular, the sensing circuitry 3 is connected to the input T1 and output T2 terminals of the output buffer device 2, and supplies the control signal RETRO on the control terminal T3.

In essence, the output buffer device 2 has a pair of PMOS transistors M3, M5 for driving the output terminal T2, whereat an output voltage value Vpad is presented. In particular, the transistor M3 is connected to the supply voltage reference Vcco for the output buffers, with Vcco being less than Vcc. The transistor T3 controls the output terminal T2 in steady or hold-on conditions, whereas the transistor M5 is connected to the supply voltage reference Vcc and controls the output terminal T2 in dynamic conditions, i.e., is only active during changes in state of the terminal T2.

The transistor M5 is controlled by the signal RETRO, which disables it (RETRO going high) upon the voltage value Vpad presented at the output terminal T2 attaining the value of the supply voltage reference Vcco for the output buffers, thereby preventing the junction of the transistor M3 connected to Vcco from becoming forward biased.

The sensing circuitry 3 could be implemented in various ways. For example, the sensing circuit 3 could include a pass gate, connected between the input terminal T1 and the control terminal T3. Thus, when the input signal Vin at the input terminal T1 transitions from high to low, the pass gate activates the transistor M5. Conversely, when the input signal Vin transitions from low to high, the pass gate deactivates the transistor T5 and the output buffer device acts like a simple CMOS inverter comprised of transistors T3 and T4. In addition, the sensing circuitry 3 could also include a comparator having a non-inverting input coupled to the output terminal T2, an inverting input coupled to the supply voltage reference Vcco, and an output coupled to the control terminal T3. With appropriate sizing of the components of the comparator and pass gate, the control terminal could be driven high when the voltage Vpad exceeds the voltage Vcco, thereby deactivating the transistor T5.

Thus in dynamic conditions, the transistor M5 will be operating in the saturation range as long as the output voltage Vpad stay lower in value than the absolute value of the threshold voltage Vtp of a PMOS transistor. It will be operating in the triode range as Vpad overcomes in absolute value the threshold voltage Vtp, to then go off upon Vpad attaining the value of the supply voltage reference Vcco for the output buffers. During the transition of Vpad from high to low, the transistor M5 is turned off and the transistors M3 and M4 provide for correct operation of the output buffer device 2.

It is significant to observe that the charge current from the transistor M5—which current adds to the charge current from the transistor M3—bears quadratic dependence on the value of the supply voltage Vcc which, as mentioned before, is higher than the voltage Vcco. Therefore, according to the principles of this invention, the dynamic response of the output buffer device 2 is thus improved, being made much faster than that of prior devices.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An output buffer device first and second supply voltage references, said first voltage reference being lower in value than said second voltage reference;

first and second MOS transistors, complimentary to each other, which transistors are connected together between said first supply voltage reference and a further voltage reference, said transistors having gate terminals connected together and to an input terminal of the buffer device; and having drain terminals connected together and to an output terminal of the buffer device and an additional MOS transistor of the same type as said first MOS transistor and placed between said second supply voltage reference and the output terminal of the output buffer device.

2. The output buffer device according to claim 1, further comprising sensing circuitry, wherein said additional MOS transistor has a gate terminal connected to a control terminal receiving a control signal issued from said sensing circuitry.

3. The output buffer device according to claim 2, wherein said sensing circuitry is connected to the input and output terminals of the output buffer device and supplies the control signal on the control terminal.

4. The output buffer device according to claim 2, wherein said additional MOS transistor is controlled by the control signal, which disables the additional MOS transistor upon the output voltage presented at the output terminal attaining the same value as that of the first supply voltage reference, thereby preventing a junction of said first transistor from becoming forward biased.

5. The output buffer device according to claim 4, wherein said additional MOS transistor is operated in a saturation range as long as the output voltage is less than the absolute value of the threshold voltage of said additional MOS transistor; is operated in the triode range as the output voltage overcomes said threshold voltage in absolute value, and is turned off when the output voltage attains the same value as the first supply voltage reference.

6. The output buffer device according to claim 1, wherein both said first MOS transistor and said additional MOS transistor are PMOS transistors, and wherein said second MOS transistor is an NMOS transistor.

7. The output buffer device according to claim 1, wherein said further voltage reference has a value lower than that of either said first or said second voltage references.

8. The output buffer device according to claim 1, wherein said further voltage reference is a ground reference.

9. An electronic device, comprising:

a first, a second and a third reference voltage wherein said first reference voltage has a lower value than said second reference voltage and said third reference voltage has a lower value than said first reference voltage;

a first and a second MOS transistor, wherein said transistors are complimentary, are arranged between said first voltage reference and said third voltage reference; have gate terminals tied together and to an input terminal of said electronic device; and have drain terminals tied together and to an output terminal of said electronic device;

a third MOS transistor, having a source connected to said second voltage reference and a drain connected to said output terminal of said electronic device;

a sensing device having a first sensing terminal connected to said input terminal of said electronic device, a second sensing terminal connected to said output terminal of said electronic device, and a control terminal connected to a gate terminal of said third MOS transistor.

10. The electronic device according to claim 9, wherein said device is an output buffer.

11. The electronic device according to claim 9, wherein said third reference voltage is a ground reference.

12. The electronic device according to claim 9, wherein said sensing device is structured to switch the control terminal to a logic low state in response to the input terminal transitioning to a logic low state.

13. The electronic device according to claim 12, wherein said sensing device is structured to switch the control terminal to a logic high state in response to the output voltage attaining at least the value of said first reference voltage.

14. The electronic device according to claim 9, wherein said sensing device is structured to switch the control terminal to a logic high state in response to the input terminal transitioning to a logic low state.

15. An electronic buffer device, comprising:

a first MOS transistor connected between a first voltage reference and an output terminal and having a gate;

a second MOS transistor connected between the output terminal and a second voltage reference, the second MOS transistor having a gate connected to the gate of the first MOS transistor and to an input terminal and being complementary to the first transistor; and means for providing a conductive path between the output terminal and a third voltage reference in response to sensing a transition at the input terminal from a first logic state to a second logic state.

* * * * *